US011126120B2

(12) United States Patent
Takahashi et al.

(10) Patent No.: US 11,126,120 B2
(45) Date of Patent: Sep. 21, 2021

(54) FIXING DEVICE AND IMAGE FORMING APPARATUS

(71) Applicant: KYOCERA Document Solutions Inc., Osaka (JP)

(72) Inventors: Hironori Takahashi, Osaka (JP); Masakazu Uehara, Osaka (JP); Tomohiro Watatani, Osaka (JP); Yuhiro Sakai, Osaka (JP); Fumito Nakamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/010,286

(22) Filed: Sep. 2, 2020

(65) Prior Publication Data

US 2021/0063929 A1 Mar. 4, 2021

(30) Foreign Application Priority Data

Sep. 3, 2019 (JP) ..... JP2019-160398

(51) Int. Cl.
*G03G 15/20* (2006.01)

(52) U.S. Cl.
CPC ..... *G03G 15/2053* (2013.01)

(58) Field of Classification Search
CPC ..... G03G 15/2017; G03G 15/2039; G03G 15/2053; G03G 2215/1639; G03G 2215/2003
See application file for complete search history.

(56) References Cited

U.S. PATENT DOCUMENTS

2016/0170338 A1* 6/2016 Tateishi ..... G03G 15/206 399/329
2017/0075266 A1* 3/2017 Mochizuki ..... H05B 3/265

FOREIGN PATENT DOCUMENTS

JP 2017-097143 A 6/2017

* cited by examiner

*Primary Examiner* — Thomas S Giampaolo II
(74) *Attorney, Agent, or Firm* — Studebaker & Brackett PC

(57) ABSTRACT

A fixing device includes a heating section. The heating section includes a heater, a heater holding member, a heat-sensitive body, a cover member, and an urging member. The heater holding member holds the heater. The heat-sensitive body faces the heater. The cover member covers the heat-sensitive body. The urging member urges the cover member in a first direction which is toward the heater from the heat-sensitive body. The urging member extends in a second direction intersecting with the first direction and engages with the heater holding member and the cover member.

5 Claims, 9 Drawing Sheets

FIXING DEVICE AND IMAGE FORMING APPARATUS

INCORPORATION BY REFERENCE

The present application claims priority under 35 U.S.C. § 119 to Japanese Patent Application No. 2019-160398, filed on Sep. 3, 2019. The contents of this application are incorporated herein by reference in their entirety.

BACKGROUND

The present disclosure relates to a fixing device and an image forming apparatus.

In a fixing device with a heating film, it is necessary for a heat-sensitive body such as a thermistor or a thermocut to be firmly held to a heater so that the temperature of the heater may be accurately measured. The fixing device uses a compressed coil spring to firmly hold the heat-sensitive body to the heater. The compressed coil spring is disposed between a metal frame stay and a heat insulating holder.

SUMMARY

A fixing device according to an aspect of the present disclosure includes a heating rotating body and a heating section. The heating section applies heat to the heating rotating body. The heating section includes a heater, a heater holding member, a heat-sensitive body, a cover member, and an urging member. The heater applies heat to the heating rotating body. The heater holding member holds the heater. The heat-sensitive body faces the heater. The cover member covers the heat-sensitive body. The urging member urges the cover member in a first direction which is toward the heater from the heat-sensitive body. The urging member extends in a second direction intersecting with the first direction and engages with the heater holding member and the cover member.

An image forming apparatus according to an aspect of the present disclosure includes the above fixing device and an image forming section. The image forming section forms a toner image on a sheet. The fixing device fixes the toner image to the sheet.

DETAILED DESCRIPTION

Figure 1:
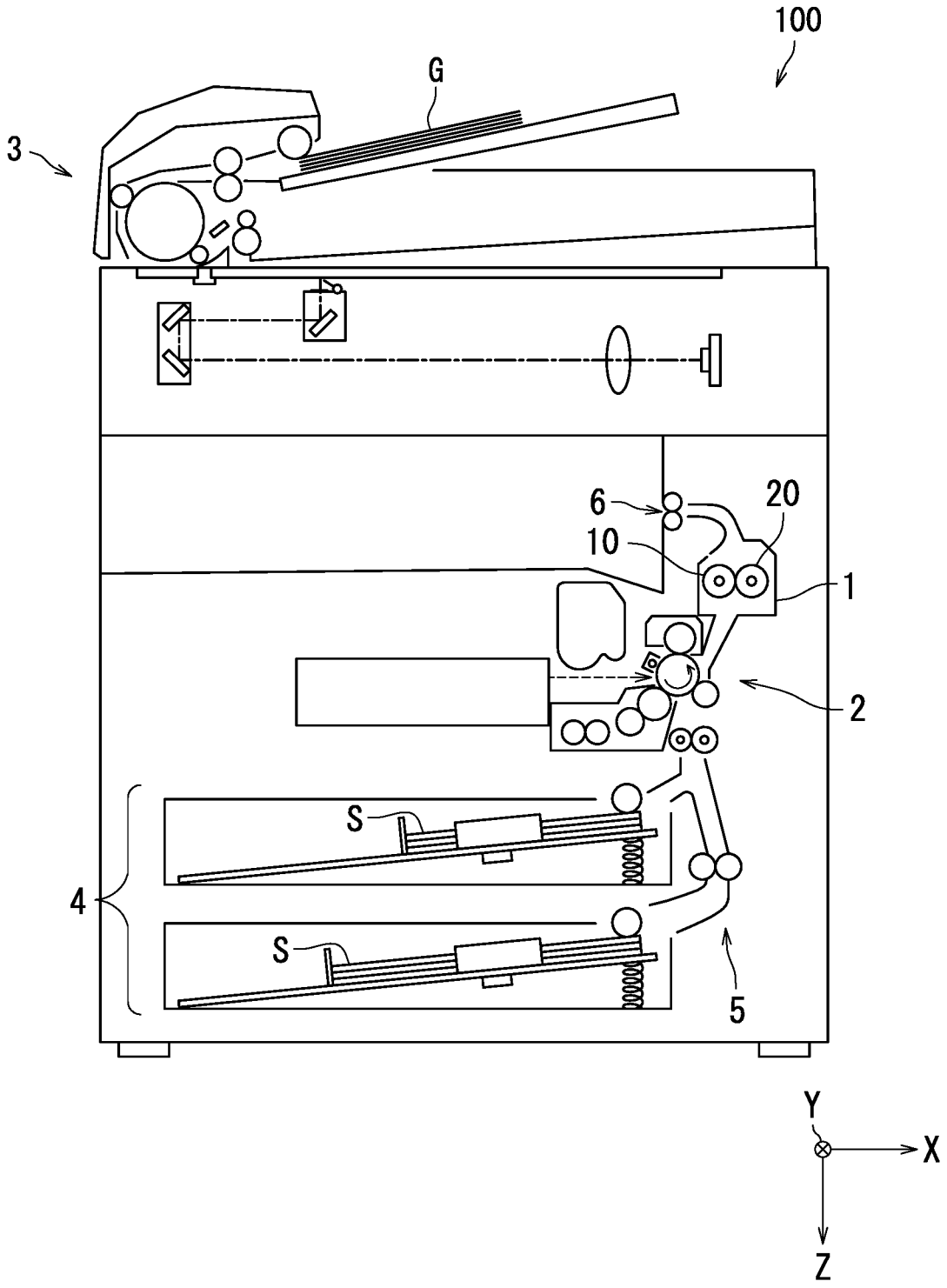
FIG. 1 is a diagram illustrating an image forming apparatus according to an embodiment of the present disclosure.

The following describes an embodiment of the present disclosure with reference to the accompanying drawings.

Note that elements that are the same or equivalent are labeled with the same reference signs in the drawings and description thereof is not repeated. Furthermore, in the present embodiment, X and Y axes of a three-dimensional Cartesian coordinate system are parallel to horizontal directions, and a Z axis thereof is parallel to a vertical direction.

A configuration and operation of an image forming apparatus 100 including a fixing device 1 is described with reference to FIG. 1. FIG. 1 is a diagram illustrating the image forming apparatus 100. Examples of the image forming apparatus 100 include a copier, a printer, a facsimile machine, and a multifunction peripheral having the functions of a copier, a printer, and a facsimile machine. In the following, an embodiment is described in which the image forming apparatus 100 is a monochrome multifunction peripheral.

As illustrated in FIG. 1, the image forming apparatus 100 includes a reading section 3, a feeding section 4, a conveyance section 5, an image forming section 2, the fixing device 1, and an ejection section 6.

The reading section 3 reads an image from a document G. The reading section 3 generates image data from the read image. The feeding section 4 houses a plurality of sheets S and feeds the sheets S to the conveyance section 5. Examples of a sheet S include a paper sheet and a synthetic resin sheet. The conveyance section 5 includes a plurality of conveyance roller pairs and conveys the sheets S to the image forming section 2.

The image forming section 2 electrographically forms a toner image on a sheet S. Specifically, the image forming section 2 includes a photosensitive drum, a charger, a light exposure device, a development device, a replenishing device, a transfer roller, a cleaner, and a static elimination device. The toner image indicates an image from the document G for example. The fixing device 1 applies heat and pressure to the toner image to fix the toner image to the sheet S. The conveyance section 5 conveys the sheet S with the toner image fixed thereto to the ejection section 6. The ejection section 6 ejects the sheet S out of the image forming apparatus 100.

Figure 2A:
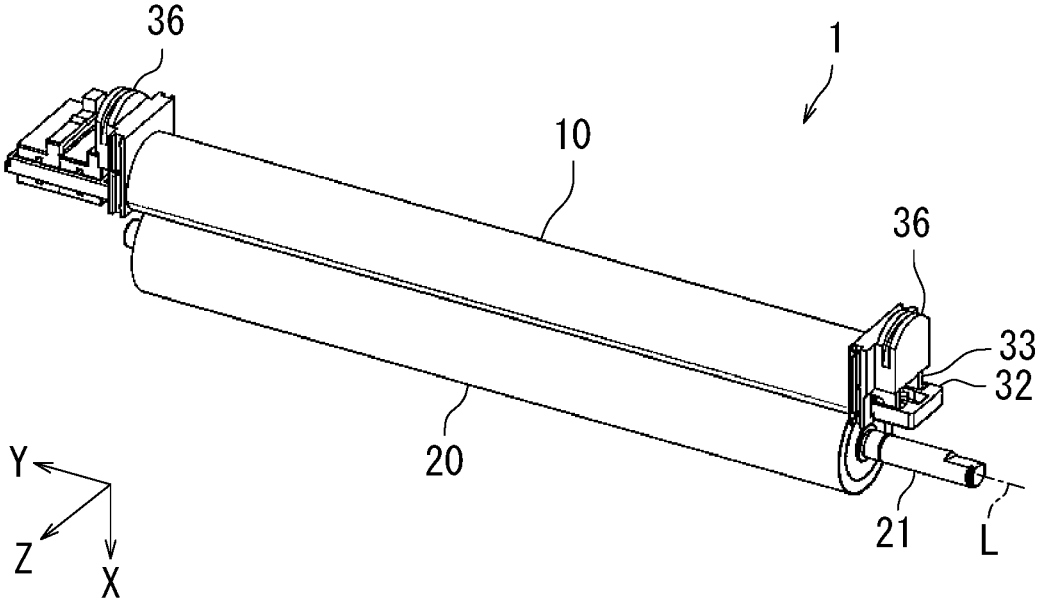
FIG. 2A is a perspective view of a fixing device.

Next, the fixing device 1 is described with reference to FIG. 2A. FIG. 2A is a perspective view of the fixing device 1. As illustrated in FIG. 2A, the fixing device 1 includes a fixing belt 10, a pressure member 20, and a belt holding member 36.

The belt holding member 36 holds two edges of the fixing belt 10 in a width direction thereof.

The fixing belt 10 corresponds to a heating rotating body. The fixing belt 10 is an endless belt. Specifically, the fixing belt 10 is substantially cylindrical and flexible. In the present embodiment, the fixing belt 10 extends in a Y-axial direction. The Y-axial direction is an example of a width direction. The width direction is orthogonal to a conveyance direction of the sheet S described with reference to FIG. 1. In the present embodiment, the sheet S passes through the fixing device 1 in a Z-axial direction. The fixing belt 10 includes a plurality of layers. The fixing belt 10 includes a polyimide layer and a release layer, for example. The release layer is fluororesin heat resistant film, for example.

The pressure member 20 is columnar. The pressure member 20 makes contact with the outer circumferential surface of the fixing belt 10 to apply pressure to the fixing belt 10 and freely rotates around a rotational axis L thereof. The pressure member 20 is a pressure roller, for example. The pressure member 20 includes a columnar metal core 21, a cylindrical elastic layer, and a cylindrical release layer, for example. The elastic layer is formed on the metal core 21, and the release layer is formed so as to cover the surface of the elastic layer. The metal core 21 is made of stainless steel or aluminum, for example. The elastic layer is elastic and is made from silicone rubber, for example. The release layer is made of fluororesin, for example.

Figure 2B:
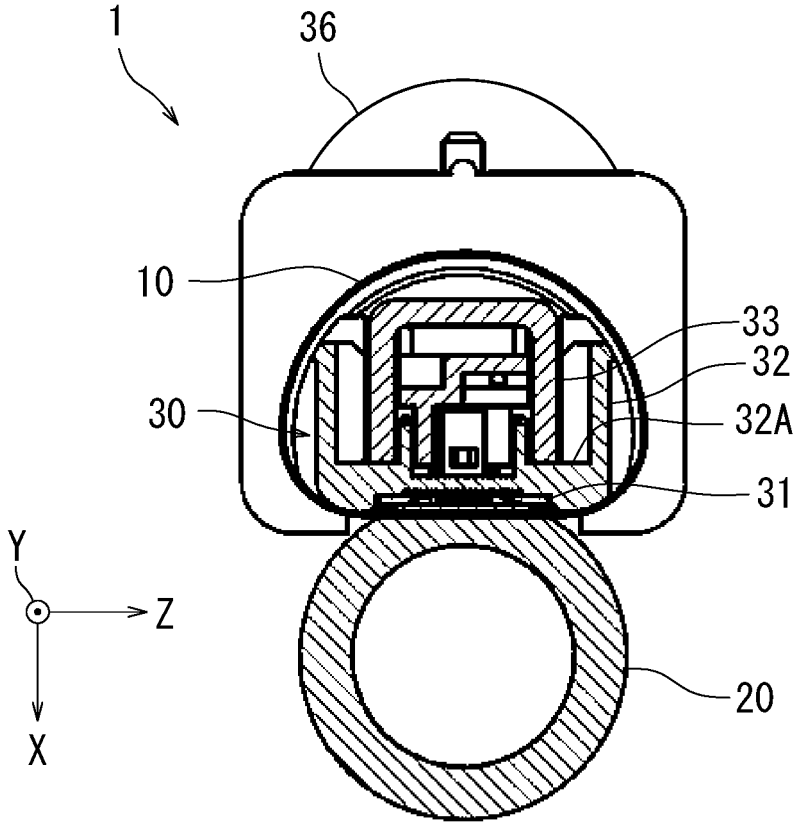
FIG. 2B is a cross-sectional view of the fixing device.

The fixing device 1 is further described with reference to FIGS. 2A and 2B. FIG. 2B is a cross-sectional view of the fixing device 1. As illustrated in FIG. 2B, the fixing device 1 further includes a heating section 30. The heating section 30 includes a heater 31, a heater holding member 32, and a reinforcing member 33. The heating section 30 is covered by the fixing belt 10. In other words, the heating section 30 faces the inner surface of the fixing belt 10. The pressure member 20 is pressed to the heater 31 through the fixing belt 10 and is in press contact with the fixing belt 10. A nip part is formed in a location where the pressure member 20 is in press contact with the fixing belt 10. As the pressure member 20 rotates, the fixing belt 10 rotates following the pressure member 20. The heater 31 applies heat to the fixing belt 10. The sheet S illustrated in FIG. 1 is conveyed in the conveyance direction of the sheet S and passes through the nip part. In passing through the nip part, a toner image is melted and fixed to the sheet S.

The heater holding member 32 faces the fixing belt 10 with the heater 31 therebetween. The heater holding member 32 engages with the reinforcing member 33. The heater holding member 32 is made from heat-resistant resin, for example. The heater holding member 32 extends along the rotational axis L of the pressure member 20.

The reinforcing member 33 reinforces the heater holding member 32. The reinforcing member 33 is a long and thin metal frame stay member, for example. The reinforcing member 33 overlaps with the heater holding member 32 in a longitudinal direction of the heater holding member 32 and faces the heater holding member 32. It should be noted that an intermediate part of the reinforcing member 33 is in a substantial inverted U-shape as viewed in a vertical cross section.

Figure 3:
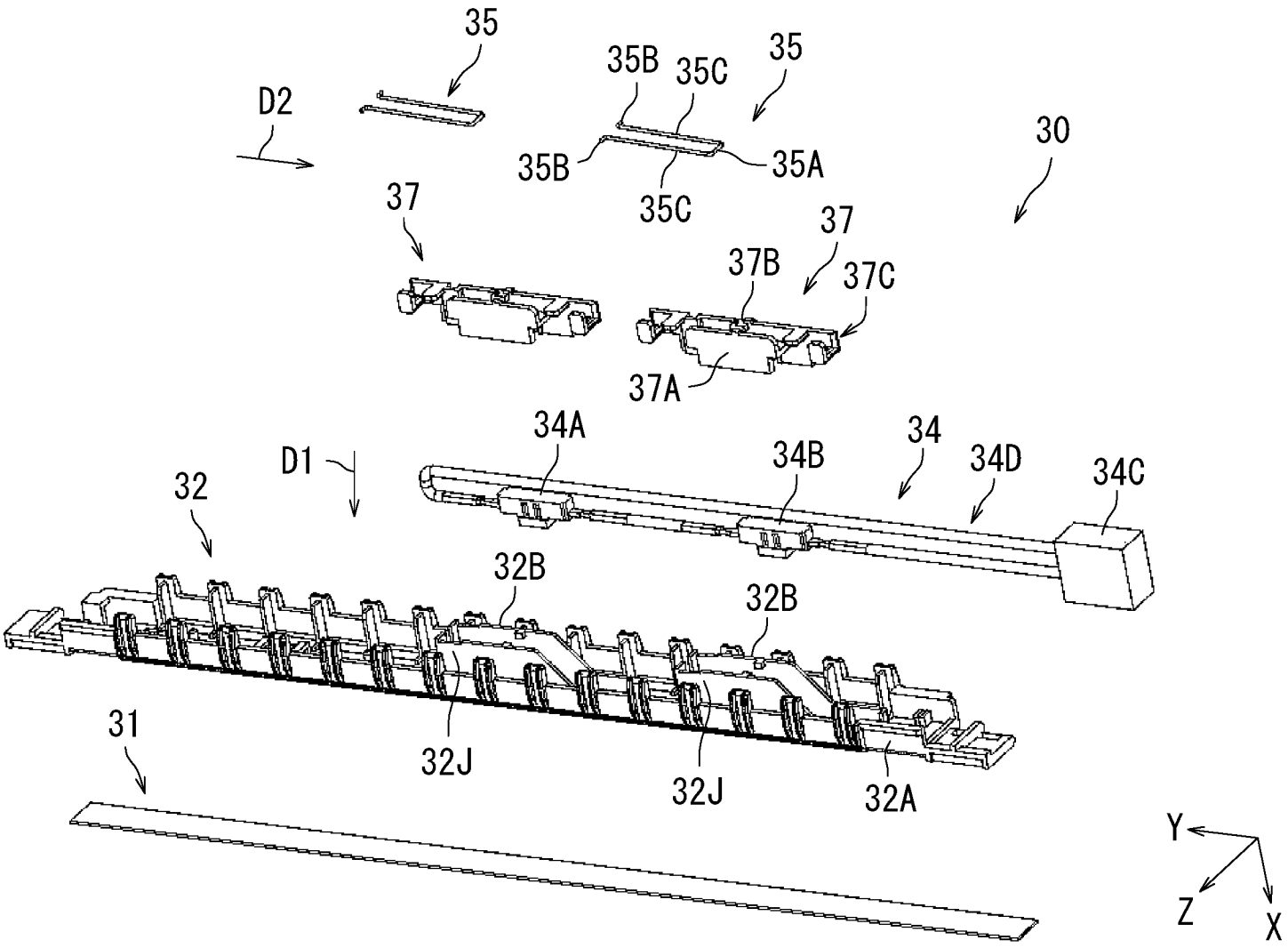
FIG. 3 is an exploded perspective view of a heating section of the fixing device.

Next, a configuration of the heating section 30 is described in detail with reference to FIG. 3. FIG. 3 is an exploded perspective view of the heating section 30. As illustrated in FIG. 3, the heating section 30 further includes a heat-sensitive body 34, cover members 37, and urging members 35. The reinforcing member 33 houses the heat-sensitive body 34, the cover members 37, and the urging members 35 in a space formed between the heater holding member 32 and the reinforcing member 33.

The heater 31 is planar or long and thin plate-shaped. The heater holding member 32 holds the heater 31. The heater holding member 32 includes a bottom wall 32A and housings 32B. Each housing 32B includes inclined surfaces 32J. The heat-sensitive body 34 detects the temperature of the heater 31. The heat-sensitive body 34 faces the heater 31. The heat-sensitive body 34 is disposed on the heater holding member 32. The heat-sensitive body 34 includes a first heat-sensitive body 34A and a second heat-sensitive body 34B. The first heat-sensitive body 34A and the second heat-sensitive body 34B are supported by the cover members 37. The part of the first heat-sensitive body 34A which detects the temperature faces the heater 31 in a position near a central portion of the heater 31. The part of the second heat-sensitive body 34B which detects the temperature faces the heater 31 in a position near an end of the heater 31.

The urging members 35 are disposed above the heater holding member 32. Each urging member 35 is a linear spring of an elastic wire bent into a prescribed shape, for example. The urging members 35 are substantially U-shaped. Two urging members 35 are provided. The two urging members 35 urge the cover members 37 in a first direction D1 toward the heater 31. The urging members 35 extend in a second direction D2 which is orthogonal to the first direction D1, and engage with the heater holding member 32 and the cover members 37. The second direction D2 is parallel to the longitudinal direction of the heater 31. Each urging member 35 includes a first end 35A, second ends 35B, and elastic deforming sections 35C.

Each first end 35A applies urging force to a corresponding one of the cover members 37. The first end 35A is a straight part of the urging member 35 extending along one side of the urging member 35. The first end 35A is held on the top of the cover member 37.

Second ends 35B are positioned on an opposite side of the urging member 35 from the first end 35A. Two second ends 35B are provided in each urging member 35. Each second end 35B is formed by bending an end of the wire forming the urging member 35. The second ends 35B are attached to a position on an upper side of a corresponding one of the housings 32B of the heater holding member 32. The second ends 35B are disposed on the inclined surfaces 32J of the housing 32B. The elastic deforming sections 35C are two straight parts of the urging member 35 extending to the second ends 35B from both sides of the first end 35A.

The elastic deforming sections 35C are located between the first end 35A and the second ends 35B. The elastic deforming sections 35C elastically deform by being pressed downward by a portion of the heater holding member 32. The elastic deforming sections 35C urge the cover members 37 toward the heater 31 due to elastic repellent force caused by elastic deformation. The elastic deforming sections 35C urge the cover members 37 regardless of whether or not the reinforcing member 33 is present.

Two cover members 37 are provided. The two respective cover members 37 cover the first heat-sensitive body 34A and the second heat-sensitive body 34B. One of the cover members 37 attaches the first heat-sensitive body 34A to the heater holding member 32. The other cover member 37 attaches the second heat-sensitive body 34B to the heater holding member 32. Each cover member 37 includes a cover main body 37A, a spring receiver 37B, and a wire housing section 37C.

Respective lower parts of the two cover main bodies 37A hold the first heat-sensitive body 34A and the second heat-sensitive body 34B from above.

Each spring receiver 37B is provided on the top of a corresponding one of the cover members 37. The spring receiver 37B is an upward-protruding rib. The spring receiver 37B has a depressed shape such as a groove. The depressed part of the spring receiver 37B supports the first end 35A of the urging member 35.

The wire housing section 37C is disposed below the spring receiver 37B.

The heat-sensitive body 34 includes a thermocut, a thermostat, or a thermistor. A thermocut is a protection element such as a one-shot thermostat. The thermocut interrupts supply of electricity to the heater 31 when the temperature of the heater 31 is equal to or greater than a threshold. In particular, in the thermocut, once the supply of electricity has been interrupted according to the temperature of the heater 31, the supply of electricity is not restored. Accordingly, when the temperature of the heater 31 has risen excessively, the heater 31 can be stopped from applying heat to the fixing belt 10 at increased precision.

A thermostat interrupts the supply of electricity to the heater 31 when the temperature of the heater 31 is equal to or greater than a threshold, and restores the supply of electricity to the heater 31 when the temperature of the heater 31 is less than the threshold. Accordingly, the heat applied to the fixing belt 10 by the heater 31 can be turned on and off with high precision according to temperature change in the heater 31.

A thermistor is a semiconductor element which measures the temperature of the heater 31. The image forming apparatus 100 controls the heater 31 based on the temperature measured by the thermistor. Because the heat-sensitive body 34 is a thermistor, the temperature of the heater 31 can be controlled with increased precision. It should be noted that the following embodiment describes a case where the heat-sensitive body 34 is a thermocut.

Figure 4:
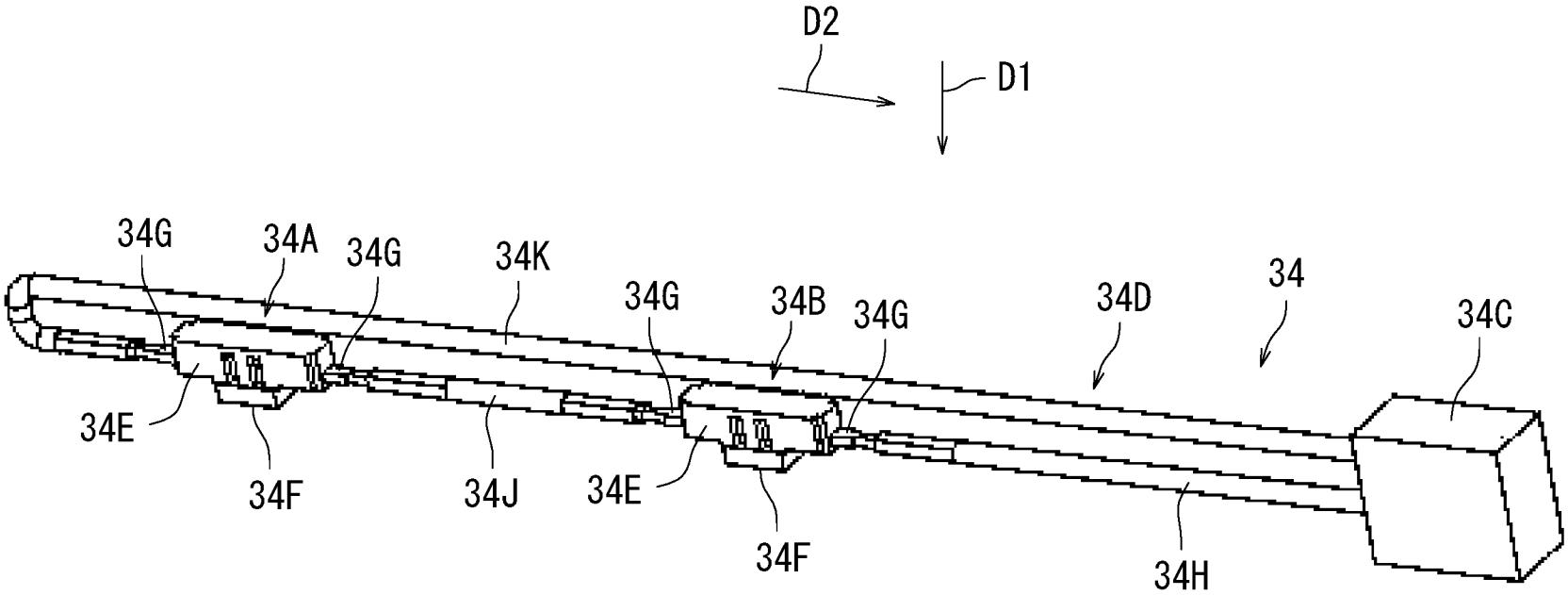
FIG. 4 is a perspective view of a heat-sensitive body.

The heat-sensitive body 34 is further described. FIG. 4 is a perspective view of the heat-sensitive body 34. As illustrated in FIG. 4, the heat-sensitive body 34 includes the first heat-sensitive body 34A, the second heat-sensitive body 34B, wiring 34D, and a connector 34C. The first heat-sensitive body 34A and the second heat-sensitive body 34B are arranged in the second direction D2 that intersects with the first direction D1 in the present embodiment. The second direction D2 is parallel to the longitudinal direction of the heater 31.

The first heat-sensitive body 34A includes a main body 34E, a detector 34F, and terminals 34G.

The main body 34E is rectangular parallelepiped-shaped. The main body 34E is supported by a corresponding one of the cover members 37. The detector 34F protrudes from the main body 34E. The bottom of the detector 34F makes contact with the heater 31. The terminals 34G protrude from both sides of the main body 34E. The terminals 34G are connected to the wiring 34D.

The second heat-sensitive body 34B has the same configuration as the first heat-sensitive body 34A. The second heat-sensitive body 34B includes a main body 34E, a detector 34F, and terminals 34G likewise to the first heat-sensitive body 34A.

The connector 34C is connected to the wiring 34D. The connector 34C is connected to the outside of the fixing device 1.

The wiring 34D includes a lower wire 34H, a connecting wire 34J, and an upper wire 34K. The lower wire 34H connects the connector 34C to the second heat-sensitive body 34B. The connecting wire 34J connects the second heat-sensitive body 34B to the first heat-sensitive body 34A. The upper wire 34K connects the first heat-sensitive body 34A to the connector 34C. The wire housing section 37C of each cover member 37 supports the wiring 34D. The wiring 34D supported by the wire housing sections 37C is disposed above the first heat-sensitive body 34A and the second heat-sensitive body 34B.

Figure 5:
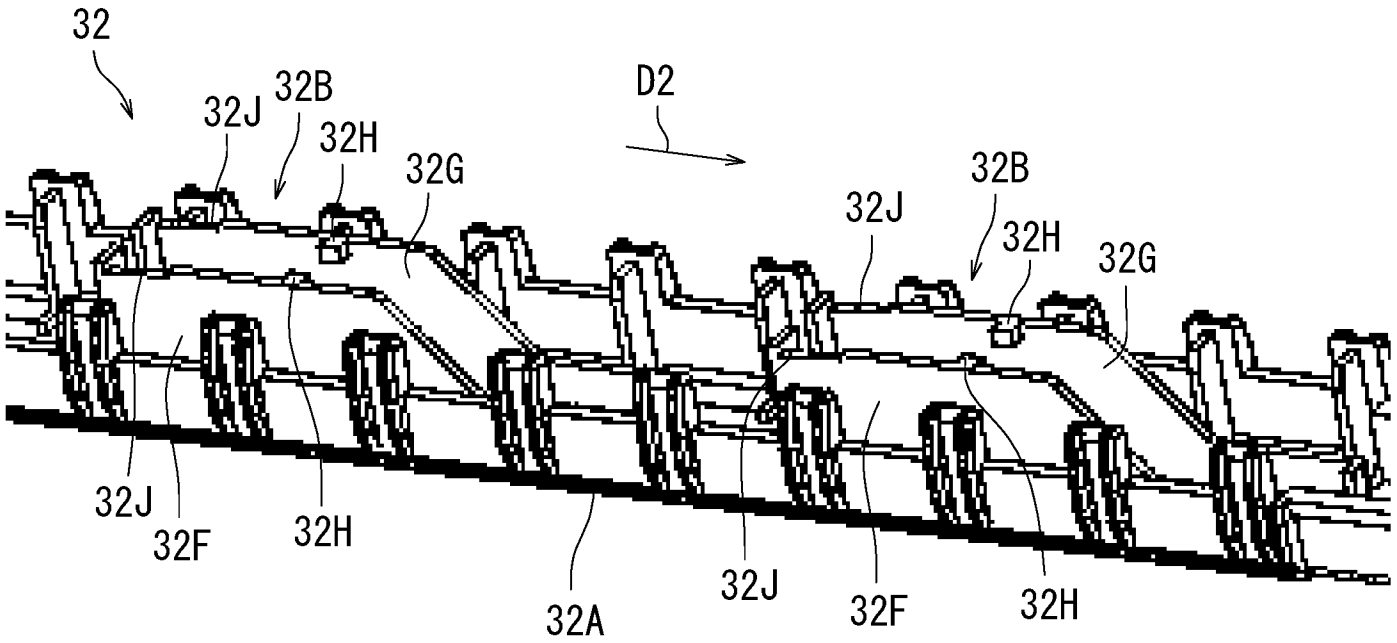
FIG. 5 is an enlarged view of the main section of a heater holding member.

The heater holding member 32 is described in detail. FIG. 5 is an enlarged view of the main section of the heater holding member 32.

As illustrated in FIG. 5, the housings 32B each include ribs erected from the bottom wall 32A. Two housings 32B are provided. Each housing 32B includes a pair of housing main bodies 32F erected from the bottom wall 32A and facing each other in a direction orthogonal to the longitudinal direction of the housing 32B, and a cover member housing section 32G located between the pair of housing main bodies 32F.

Each housing main body 32F includes a spring retainer 32H and an inclined surface 32J. The spring retainers 32H are a pair of protrusions protruding toward each other in a direction orthogonal to the longitudinal direction of the bottom wall 32A. The inclined surfaces 32J are formed so as to incline toward the bottom wall 32A in a direction away from the corresponding spring retainers 32H.

Each cover member housing section 32G supports a corresponding one of the cover members 37 in a position adjacent to the bottom wall 32A in the housing 32B.

Figure 6:
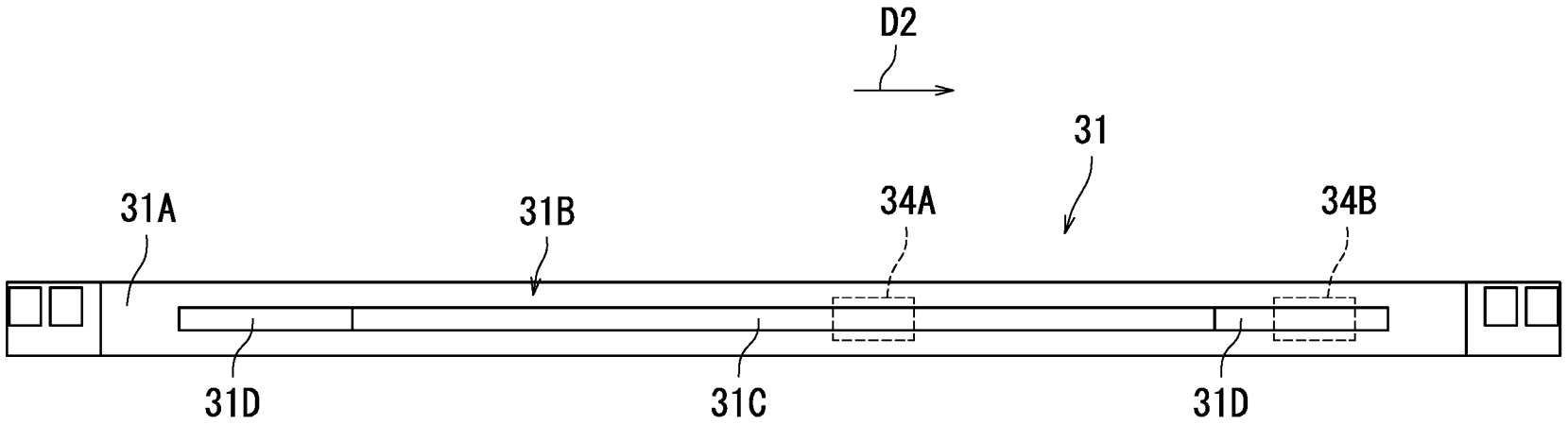
FIG. 6 is a diagram illustrating the positional relationship between a heater and the heat-sensitive body.

Next, the heater 31 is described with reference to FIG. 6. FIG. 6 is a diagram illustrating the positional relationship between the heater 31 and the heat-sensitive body 34. As illustrated in FIG. 6, the heater 31 is a ceramic heater for example, and includes a ceramic substrate 31A and a resistive heating element 31B. The thickness of the heater 31 is 1 mm, for example.

The resistive heating element 31B includes a plurality of heating elements arranged in the second direction D2 intersecting with the first direction D1. The first direction D1 is toward the heater 31 from the heat-sensitive body 34, and the second direction D2 is parallel to the longitudinal direction of the heater 31 in the present embodiment. The resistive heating element 31B includes a central heating element 31C and end heating elements 31D. The length of the central heating element 31C is longer than the end heating elements 31D in the longitudinal direction of the resistive heating element 31B. The end heating elements 31D are disposed on either side of the central heating element 31C. Two end heating elements 31D are provided. The central heating element 31C and the two end heating elements 31D apply heat to the fixing belt 10. The first heat-sensitive body 34A and the second heat-sensitive body 34B are disposed in locations indicated by dotted lines in FIG. 6. The first heat-sensitive body 34A detects the temperature of the central heating element 31C. The second heat-sensitive body 34B detects the temperature of one of the end heating elements 31D.

The following particularly describes a state where the urging members 35, the cover members 37, and the heat-sensitive body 34 are fitted to the heater holding member 32 with reference to FIGS. 7A to 9B.

Figure 7A:
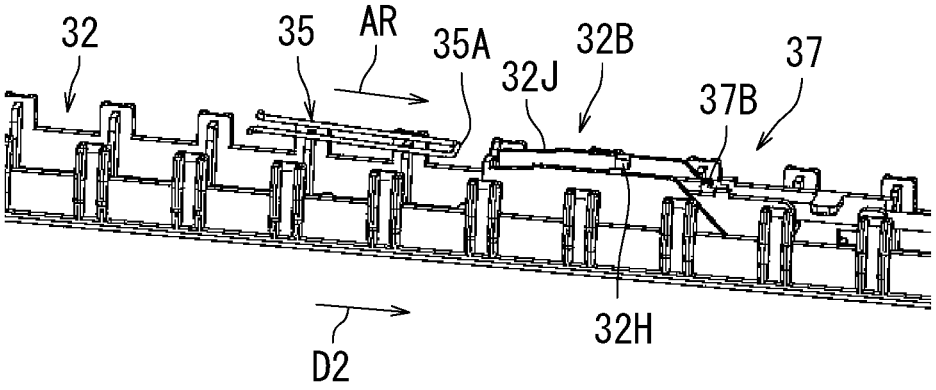
FIG. 7A is a perspective view of a process by which an urging member is attached.

FIG. 7A is a perspective view of a process by which one of the urging members 35 is attached. First, the first end 35A is inserted in the direction of an arrow AR.

Figure 7B:
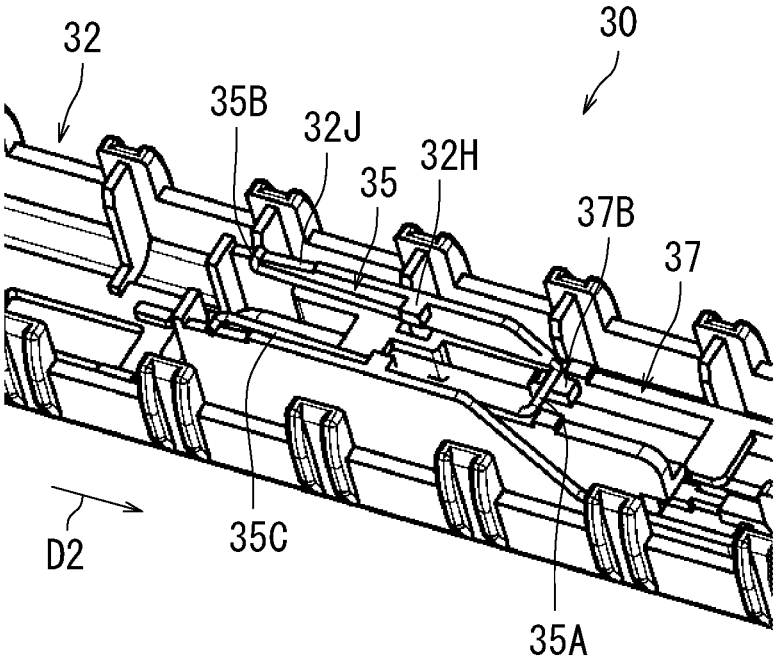
FIG. 7B is a perspective view of a state where attachment of the urging member is completed.

FIG. 7B is a perspective view of a state where attachment of the urging member 35 is completed. The first end 35A is disposed on the spring receiver 37B of a corresponding cover member 37. The second ends 35B are located opposite to the corresponding inclined surfaces 32J of the housing 32B. The elastic deforming sections 35C are disposed below the spring retainers 32H. The second ends 35B are each arranged in the center of a corresponding inclined surface 32J. In the state illustrated in FIG. 7B, an urging member 35 is urging a corresponding cover member 37.

Figure 8:
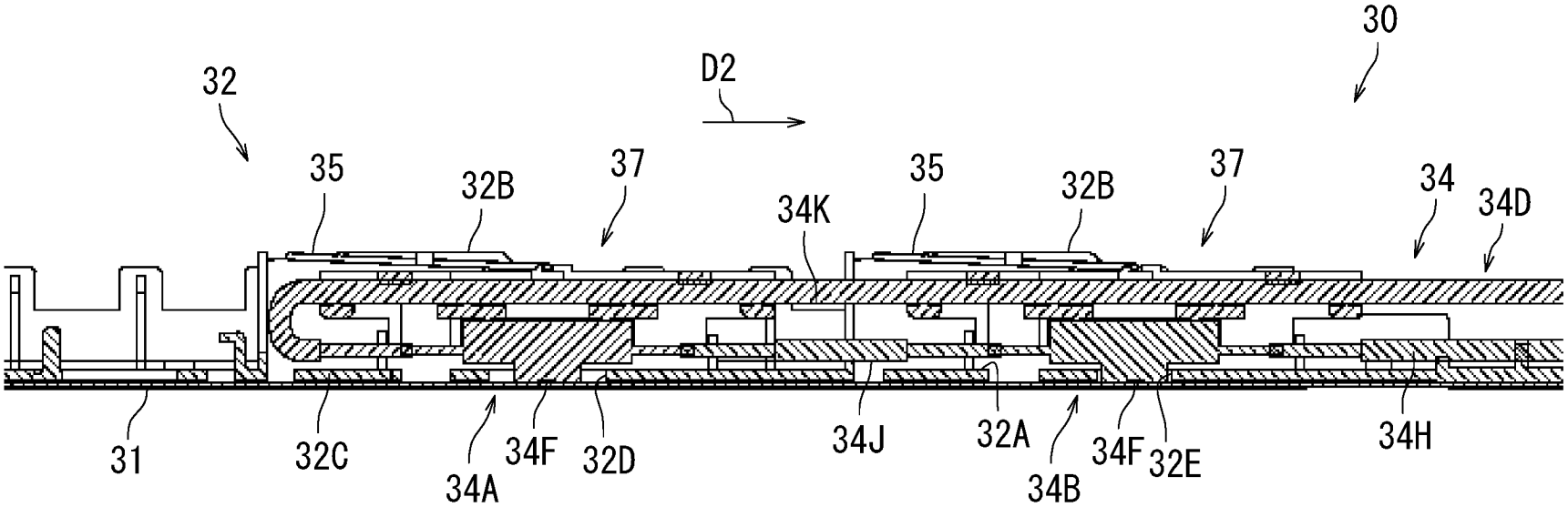
FIG. 8 is a cross-sectional view of a portion of the heating section.

FIG. 8 is a cross-sectional view of a portion of the heating section 30. As illustrated in FIG. 8, the heater holding member 32 further includes a heater housing section 32C. The bottom wall 32A has a fitting hole 32E and a long hole 32D. The heater housing section 32C has an indentation extending over the entire substantial area of the lower surface of the bottom wall 32A. The heater housing section 32C is fitted to the heater 31.

The detector 34F of the second heat-sensitive body 34B is fixed to the fitting hole 32E. In the state illustrated in FIG. 8, the two urging members 35 have the same posture. One of the urging members 35 urges the first heat-sensitive body 34A through the corresponding cover member 37. The other urging member 35 urges the second heat-sensitive body 34B through the corresponding cover member 37. In other words, the first heat-sensitive body 34A and the second heat-sensitive body 34B are urging the heater 31 with the same amount of force.

Figure 9A:
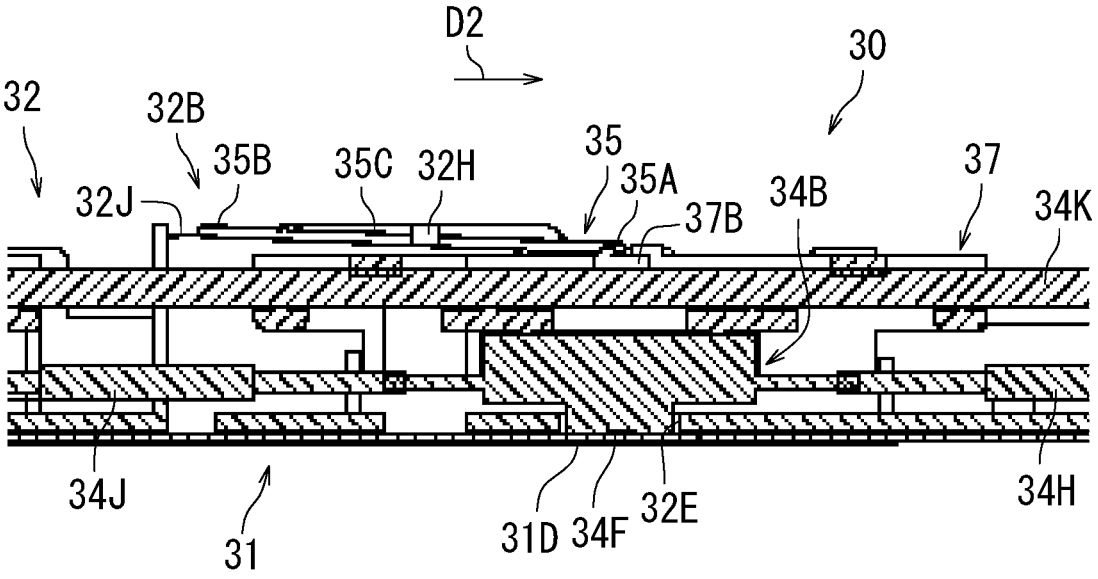
FIGS. 9A and 9B are enlarged diagrams illustrating the main section of FIG. 8.
Figure 9B:
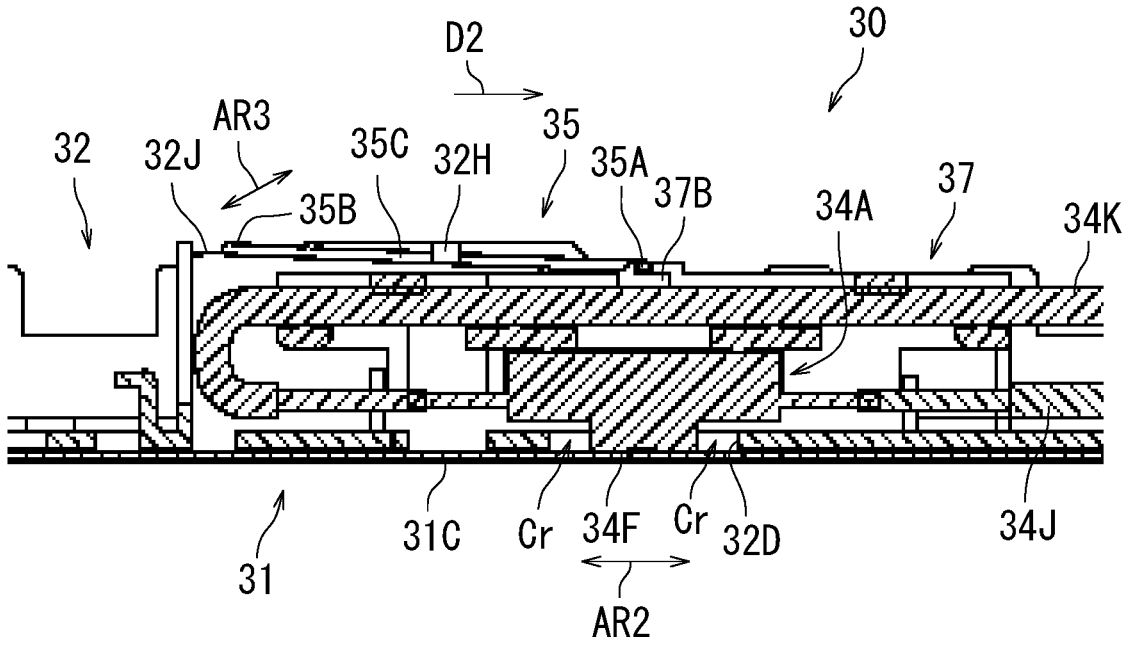

FIGS. 9A and 9B are enlarged diagrams illustrating the main section of FIG. 8. As illustrated in FIG. 9A, the detector 34F of the second heat-sensitive body 34B is fitted to the fitting hole 32E with substantially no gap. As a result, the second heat-sensitive body 34B does not change position in the longitudinal direction of the resistive heating element 31B. The second heat-sensitive body 34B can stably detect the temperature of the one end heating element 31D which has a small length. The second ends 35B do not move from the center of each inclined surface 32J in the longitudinal direction of the inclined surfaces 32J. Furthermore, the posture of the urging member 35 does not change. As a result, the second heat-sensitive body 34B always pushes the end heating element 31D of the heater 31 with a constant amount of force.

As illustrated in FIG. 9B, a clearance Cr is left between the long hole 32D and the detector 34F of the first heat-sensitive body 34A. In other words, the first heat-sensitive body 34A is arranged so as to freely slide in the longitudinal direction of the heater 31. Due to the presence of the clearance Cr, the connecting wire 34J is effectively prevented from being forcibly pulled or loosened even if the distance between the first heat-sensitive body 34A and the second heat-sensitive body 34B differs from a prescribed distance.

In addition, due to provision of the clearance Cr, the second ends 35B move in the direction of an arrow AR3 when the first heat-sensitive body 34A is displaced in the direction of an arrow AR2. The direction of the arrow AR3 is a diagonal direction in the drawing, and the direction of the arrow AR2 is a horizontal direction in the drawing. To describe specifically, when the detector 34F of the first heat-sensitive body 34A is provided in a position displaced in any direction from the state illustrated in FIG. 9B, the spring receiver 37B of the corresponding cover member 37 is also provided in an accordingly displaced position. When the position of one of the spring retainers 32H does not change while the position of the corresponding spring receiver 37B does change, the shape of the corresponding urging member 35 changes.

In the present embodiment, due to the second ends 35B being positioned on the corresponding inclined surfaces 32J, a bend amount of the urging member 35 never changes even if the position of the first heat-sensitive body 34A changes. As a result, the central heating element 31C of the heater 31 can be pressed with a constant amount of pressing force. It should be noted that the angle at which the inclined surfaces 32J are inclined is set such that the bend amount of the corresponding urging member 35 never changes even when the position of the first heat-sensitive body 34A changes.

Here, it is assumed that the inclined surfaces 32J are not provided. The second ends 35B of each urging member 35 are always kept at the same height position. As a result, the bend amount of the urging member 35 changes when the position of the first heat-sensitive body 34A changes. On the assumption that the inclined surfaces 32J are not provided in the configuration illustrated in FIG. 9B, the bend amount of the urging member 35 increases if the first heat-sensitive body 34A is displaced leftward in the drawing. As a result, the detector 34F of the first heat-sensitive body 34A presses the heater 31 more strongly. If the first heat-sensitive body 34A is displaced rightward in the drawing, the detector 34F of the first heat-sensitive body 34A presses the heater 31 more weakly. As a result, the detectors 34F press the heater 31 with a different amount of force between the first heat-sensitive body 34A and the second heat-sensitive body 34B. In other words, the performance of the heat-sensitive body 34 declines.

In the present embodiment by contrast, there is no difference between the first heat-sensitive body 34A and the second heat-sensitive body 34B in the force by which the respective detectors 34F press the heater 31. As a result, the fixing device 1 of the present embodiment can detect the temperature of the heater 31 with high precision.

As described above with reference to FIGS. 3 to 9B, the fixing device 1 in the present embodiment has a shape in which the urging members 35 extend in the second direction D2 which intersects with the first direction D1 that is from the heat-sensitive bodies 34 toward the heater 31. As a result, the heating section 30 is realized with less volume. Specifically, space is reduced between the heater holding member 32 and the reinforcing member 33.

Furthermore, each urging member 35 is a linear spring in the present embodiment. As a result, space is further reduced between the heater holding member 32 and the reinforcing member 33. The wiring 34D is provided in the space between the heater holding member 32 and the reinforcing member 33. The urging member 35 does not interfere with the wiring 34D at all. This means that the above-mentioned space reduction is compatible with an increase in the degree of freedom in designing the heating section 30.

Furthermore, in the fixing device 1, the first heat-sensitive body 34A and the second heat-sensitive body 34B detect the temperature of the resistive heating element 31B. As a result, performance improvement is realized in detecting the temperature of the resistive heating element 31B.

In the fixing device 1, the first heat-sensitive body 34A slides freely while the second heat-sensitive body 34B is fixed. As a result, the performance in detecting the temperature of the heater 31 is stably maintained even when there is an individual difference in distance between the first heat-sensitive body 34A and the second heat-sensitive body 34B.

Additionally, in the fixing device 1, the urging force of the urging member 35 corresponding to the first heat-sensitive body 34A does not change due to provision of the inclined surfaces 32J even when there is an individual difference in distance between the first heat-sensitive body 34A and the second heat-sensitive body 34B.

An embodiment of the present disclosure is described above with reference to the accompanying drawings. However, the present disclosure is not limited to the above embodiment and may be implemented in various manners within a scope not departing from the gist thereof. For example, some of elements of configuration may be removed from all of the elements of configuration illustrated in the embodiment. The drawings mainly illustrate the elements of configuration schematically to facilitate understanding. Aspects such as thickness, length, number, and interval of the elements of configuration illustrated in the drawings may differ in practice for convenience of drawing preparation. Furthermore, aspects such as material, shape, and dimension of the elements of configuration illustrated in the above embodiment are merely examples and not particular limitations. The elements of configuration may be variously altered within a scope not substantially departing from the configuration of the present disclosure.

Furthermore, as described with reference to FIG. 1, the image forming apparatus 100 is a monochrome multifunction peripheral. However, the present disclosure is not limited as such. The image forming apparatus 100 need only be electrographic. For example, the image forming apparatus 100 may be a color multifunction peripheral.

What is claimed is:

1. A fixing device comprising:

a heating rotating body; and a heating section configured to apply heat to the heating rotating body, wherein the heating section includes:

a heater which applies heat to the heating rotating body;

a heater holding member which holds the heater;

a heat sensing body facing the heater;

a cover member which covers the heat sensing body; and an urging member which urges the cover member in a first direction which is toward the heater from the heat sensing body, the urging member extends in a second direction intersecting with the first direction and engages with the heater holding member and the cover member, the heat sensing body includes:

a first heat-sensing body and a second heat-sensing body arranged in the second direction; and wiring connected with the first heat-sensing body and the second heat-sensing body, the first heat-sensing body is supported by the heater holding member so as to slide freely, and the second heat-sensing body is fixed to the heater holding member.

2. The fixing device according to claim 1, wherein the urging member of the heating section is a linear spring of an elastic wire bent into a prescribed shape.

3. The fixing device according to claim 1, wherein the heater includes a plurality of heating elements arranged in the second direction, and the heating elements apply heat to the heating rotating body.

4. The fixing device according to claim 1, wherein the urging member has:

a first end which applies urging force to the cover member; and a second end positioned on an opposite side of the urging member from the first end, and the heater holding member has an inclined surface to which the second end is located opposite.

5. An image forming apparatus comprising:

the fixing device according to claim 1; and an image forming section configured to form a toner image on a sheet, wherein the fixing device fixes the toner image to the sheet.

* * * * *